United States Patent [19]

Mailliet et al.

[11] Patent Number: 4,602,770

[45] Date of Patent: Jul. 29, 1986

[54] TAPHOLE DRILLING DEVICE FOR SHAFT FURNACES

[75] Inventors: Pierre Mailliet, Howald; Charles Tarducci, Esch sur Alzette; Henri Radoux, Luxembourg; Guy Thillen, Diekirch, all of Luxembourg

[73] Assignee: Paul Wurth S.A., Luxembourg, Luxembourg

[21] Appl. No.: 618,571

[22] Filed: Jun. 8, 1984

[30] Foreign Application Priority Data

Jun. 8, 1983 [LU] Luxembourg ..... 84855

[51] Int. Cl.[4] ..... C21B 7/12

[52] U.S. Cl. ..... 266/271; 266/45; 175/62

[58] Field of Search ..... 266/271, 45; 175/62, 175/122, 220

[56] References Cited

U.S. PATENT DOCUMENTS

| | | | |
|---|---|---|---|
| 3,232,360 | 2/1966 | Dickinson | 175/220 X |
| 4,418,894 | 12/1983 | Mailliet | 266/271 |
| 4,431,171 | 2/1984 | Foster | 266/271 |

FOREIGN PATENT DOCUMENTS

| | | | |
|---|---|---|---|
| 0064644 | 11/1982 | European Pat. Off. | 266/271 |
| 2815730 | 12/1978 | Fed. Rep. of Germany | 266/271 |
| 993365 | 5/1965 | United Kingdom | 266/271 |
| 0854989 | 8/1981 | U.S.S.R. | 266/271 |

*Primary Examiner*—James A. Leppink
*Assistant Examiner*—David J. Bagnell
*Attorney, Agent, or Firm*—Fishman & Dionne

[57] ABSTRACT

A taphole drilling device for shaft furnaces is presented which is controlled by hydraulic fluid means. The taphole drilling device is particularly suitable for use in conjunction with a drilling process wherein the opening and closing of the taphole comprises the positioning and extraction of a drill rod which is left inside the taphole between successive tappings. One embodiment of the present invention essentially comprises a bar, a uni-directional percussion instrument which slides along the bar under the action of a motor, a device for coupling the drill rod to the percussion instrument and a means provided at the front end of the bar for guiding and supporting the drill rod. It will be appreciated that the motor used to drive the percussion instrument is preferably a hydraulic motor. In a second embodiment, a hydraulic jack is used to initially disengage the drill rod from the taphole and thereafter the drill rod is extracted under the action of a uni-directional percussion instrument powered by a pneumatic or hydraulic motor.

12 Claims, 9 Drawing Figures

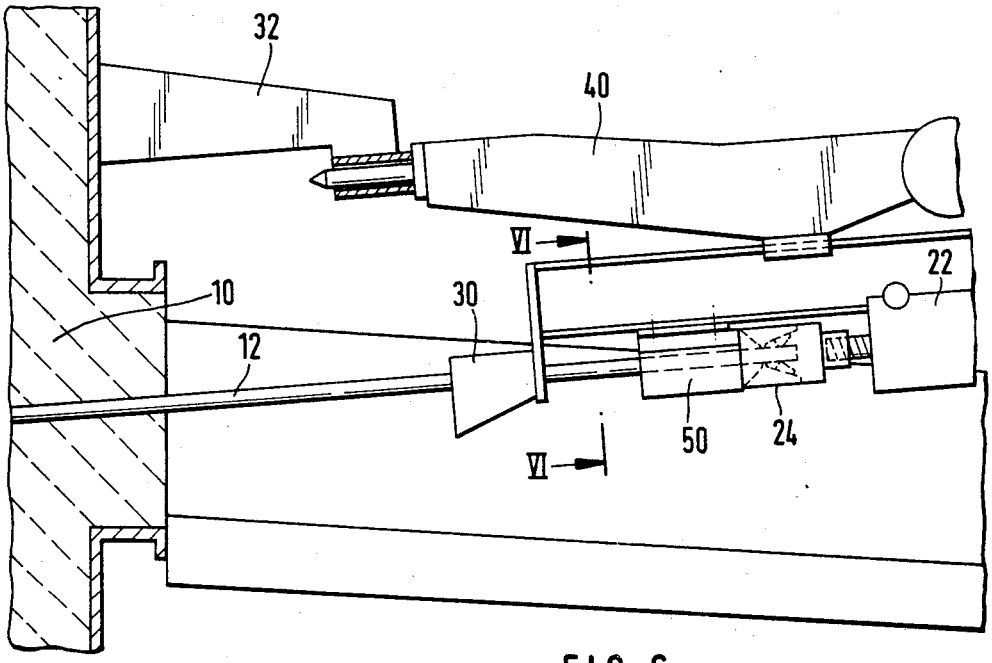
FIG. 6
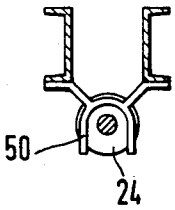
FIG. 6a
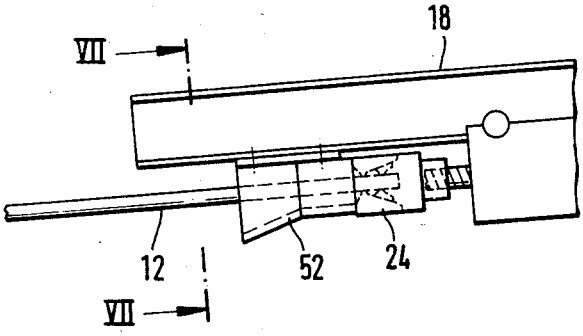
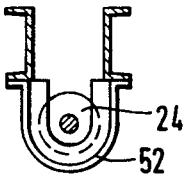
FIG. 7a
FIG. 7

TAPHOLE DRILLING DEVICE FOR SHAFT FURNACES

BACKGROUND OF THE INVENTION

This invention relates to the field of taphole drilling in a shaft furnace. More particularly, this invention relates to a new and improved taphole drilling or opening device for shaft furnaces utilizing hydraulic power means and a uni-directional percussion instrument.

Presently, a method used in closing and opening the taphole in a shaft furnace comprises the positioning and extraction of a drill rod which is left inside the taphole between successive tappings. This relatively new method usually comprises the use of a pneumatic percussive working tool which exerts a bi-direction (i.e., forward and backward) action on the drill rod during the extraction thereof. The use of this recent drilling or taphole opening process has become increasingly widespread. Nevertheless, this process cannot be used in all circumstances. Accordingly, certain types of tapholes still necessitate the conventional method of drilling with a rotary percussion bit.

One particular disadvantage of this new taphole opening process is the fact that the rod can only be extracted from the taphole by means of a non-rotary percussive motion which includes both a forward and backward action. Thus, if it is desired to use a device or working tool which is capable of carrying out both the new taphole opening process and the conventional rotary drilling method, such a working tool must be capable of both drilling by rotation and exerting a percussive forward and backward (bi-directional) action.

Patent Application EP-A 0052248 corresponding to U.S. Pat. No. 4,497,379, all of the contents of which are incorporated herein by reference, discloses a hydraulic feed system which is especially designed for taphole drilling machines. The device disclosed therein permits the pneumatic tools to be replaced by hydraulic tools in taphole drilling devices. It is well known to those skilled in the art that hydraulic control offers numerous features and advantages over pneumatic tools. These advantages essentially consist of far greater power obtainable by hydraulic fluid as well as a considerable reduction in the noise produced thereby. Nevertheless, the hydraulic control system as disclosed in U.S. Pat. No. 4,497,379 has not been adapted to devices which are capable of opening and closing furnace taphole by both rotary percussive drilling and percussive bi-directional action. This situation has arisen because at present, there is no hydraulic bi-directional percussion tool.

Simple replacement or substitution of the pneumatic tool by a hydraulic tool, utilizing the added force of the hydraulic control as an aid in the extraction of a drill rod has also not been suggested or contemplated because, as prior art devices include a bar which is mounted at the end of a relatively long carrier arm, either the reaction in the latter will be too great or the arm (and the main pivot on which the arm moves) will have to be made very strong.

SUMMARY OF THE INVENTION

The above discussed and other problems of the prior art are overcome or alleviated by the taphole drilling or opening device of the present invention. In accordance with the present invention, a novel taphole drilling or opening device is provided which is controlled by hydraulic fluid means and which is capable of functioning by both conventional drilling processes, i.e., rotary percussion and the more popular drilling method wherein a drill rod is left in the taphole between successive tappings.

The taphole drilling device of the present invention is particularly suitable for use in conjunction with a taphole opening process wherein the opening and closing of the taphole comprises the positioning and extraction of a drill rod which is left inside the taphole between two successive tappings. One embodiment of the present invention essentially comprises a bar mounted at the free end of a carrier arm, a percussion instrument which slides along the bar under the action of a motor, a device for coupling the drill rod to the percussion instrument and a means provided at the front end of the bar for guiding and supporting the drill rod. It will be appreciated that the motor used to drive the percussion instrument is a hydraulic motor of sufficient power to extract the drill rod even without the aid of the percussion instrument. The present invention further comprises means whereby the bar can come to rest or be supported on the wall of the furnace during the drill rod extraction under the action of the hydraulic motor.

The percussion instrument used in accordance with the present invention is a uni-directional percussion device which, in addition to the advantage of being operable by hydraulic fluid means, also has the advantage of being relatively shorter than the pneumatic bi-directional percussion devices used in the prior art.

The above discussed support means which acts to guide and support the drill rod preferably consist of male and female supporting elements provided on the wall of the furnace and on the bar respectively. In one particularly advantageous embodiment, the supporting means may consist of structural elements analogous to those disclosed in patent application No. DE-A.2815730, all the contents of which are incorporated herein by reference. However, it will be appreciated that while the elements in patent application No. DE-A.2815730 serve solely as guiding and stabilizing means, the elements utilized by the present invention serve primarily as supporting means and only secondarily as guiding means.

In a first embodiment of the present invention, the supporting element provided on the bar is integral therewith while in a second embodiment, the supporting element forms part of a support integral with the free end of the carrier arm. In the second embodiment, the bar is suspended on the support by sliding bars which enable it to slide along the support. The support includes a hydraulic jack which is connected to the bar. The hydraulic jack causes the bar to undergo a translatory movement in relation to the support and carrier arm.

Thus, the hydraulic jack is used to initially disengage the drill rod from the taphole and thereafter the drill rod is extracted under the action of a uni-directional percussion instrument powered by a pneumatic or hydraulic motor.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES:

FIG. 6 is a side elevation view, partly in cross-section, showing a device which locks the working tool in position and is used in conjunction with the embodiment of the drilling device shown in FIGS. 3–5.

FIG. 6A is a cross-sectional elevation view along the line 6—6 of FIG. 6.

FIG. 7 is a side elevation view showing a variation of the locking device shown in FIG. 6.

FIG. 7A is a cross-sectional elevation view along the line 7—7 of FIG. 7.

DESCRIPTION OF THE PREFERRED EMBODIMENT

Figure 1:
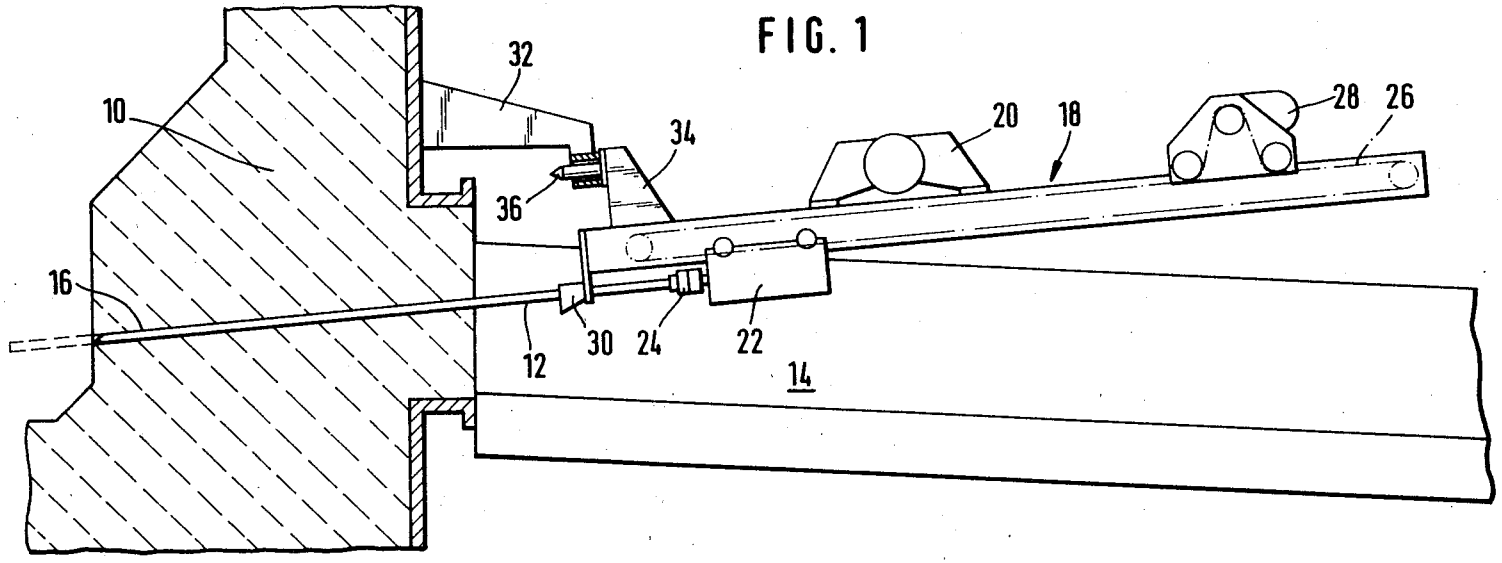
FIG. 1 is a side elevation view, partly in cross-section, of a first embodiment of a drilling device shown in an operating position in accordance with the present invention.

Referring first to FIG. 1, a portion of a blast furnace wall 10 is shown traversed by a drill rod 12 which, after being slightly extracted from the position shown, exposes a taphole 16 which permits cast iron or other molten material to flow into a tap channel identified at 14. The inner end 16 of rod 12 is shown in dot-and-dash lines as this portion of rod 12 has been previously consumed and melted by the molten material.

The drilling or opening device of the present invention comprises an elongated bar 18 which is supported by the end of a carrier arm 20 which is swingably mounted on a main pivot (not shown). A working or percussive tool 22 is provided with a coupling 24 which acts to connect tool 22 to drill rod 12. Tool 22 is slidably engaged to bar 18 and is slidably driven along the bar under the action of an endless conveyor chain 26 which in turn, is driven by a motor 28. A guiding and supporting head 30 is provided at one end of bar 18. The primary function of guiding and supporting head 30 is to support drill rod 12 when it is no longer or not yet supported within taphole 16.

As mentioned hereinabove, in the prior art, a drilling device capable of performing both presently used drilling processes (i.e., rotary and bi-directional) had to be provided with a working tool having a percussion device capable of acting both forwards and backwards, the motor for the translatory movement of the working tool being a pneumatic motor. As discussed, a device of this type has many deficiencies and drawbacks.

The present invention overcomes the problems of the prior art by eliminating both forward and backward action by the use of a hydraulic motor 28 thereby taking advantage of the added power of hydraulic fluid so as to no longer necessitate a rear or backward action percussive device. The present invention therefor permits drill rod 12 to be extracted solely by the uni-directional force exerted on working tool 22 when it is driven by chain 26 via hydraulic motor 28. It will be appreciated by those skilled in the art that for rod 12 to be extracted in this manner, and particularly for its release in the initial extraction phase, the traction force of hydraulic motor 28 must be equal to at least 5 tons. Moreover, in modern high capacity blast furnaces wherein the taphole may be 3 meters or more in length and wherein a very hard anhydrous plugging compound is used therein, the necessary extraction force may be on the order of 10 tons. It will be appreciated by those skilled in the art that prior art pneumatic motors usually do not develop more than 2 tons force and therefor, cannot be used in conjunction with the present invention. Of course, with the distinct increase in traction force as a result of hydraulic motor 28, the conveyor chain 26 must also be provided with adequate strength.

In addition to the well known advantages of hydraulic motor control, the drilling or opening device of the present invention permits construction of the working tool 22 to be of a relatively moderate length. This smaller length relative to prior art devices is made possible by the elimination of one of the two percussion directions which were necessitated in earlier devices. Accordingly, the present invention makes it possible either to reduce the length of bar 18 or to increase the size of the taphole 16, either alternative being an advantage over the prior art. The elimination of bi-directional percussive action during operation of extracting the drill rod 12 also eliminates undesirable vibrations and consequently reduces the stresses undergone by coupling device 24. It is well known that rod extractions carried out by prior art bi-directional percussion devices have always involved the danger that the automatic clamp of a coupling device which connects the drill rod to the percussion device may be unlocked. Also, prior art percussion devices may damage the male and female threads of the coupling device as a result of repeated impacts occuring each time the taphole is opened.

In order to permit the increased reaction tractive forces from being transmitted to carrier arm 20 and to the main pivot (not shown) of the drilling device, a structure is provided which permits bar 18 to rest against wall 10 of the shaft furnace during the extraction phase. Thus, the embodiment of the present invention shown in FIG. 1 is provided with a support 34 attached to the forward end of bar 18. Support 34, in turn, is provided with a male extention or finger 36 which, in the operative position shown in FIG. 1, penetrates an aperture on an arm 32, arm 32 extending from and being attached to wall 10 of the furnace. The version of the support structure illustrated in FIG. 1 is primarily intended for drilling devices wherein the trajectory of bar 18 near the operative position is essentially in the direction of the taphole.

Figure 2:
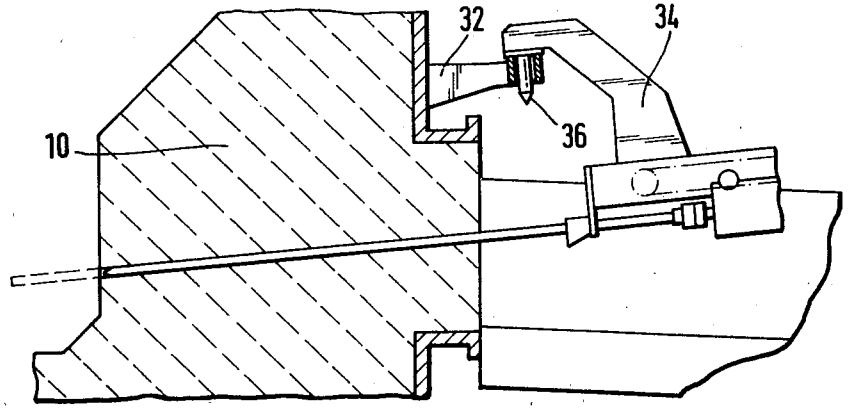
FIG. 2 is a side elevation view, partly in cross-section, of a variation of a portion of the drilling device of FIG. 1 in accordance with the present invention.

For those devices wherein the trajectory of the drill rod in the approach to the operative position is primarily vertical, i.e., devices in which a supplementary descent and/or oblique movement is performed, a support should be used such as that shown in FIG. 2. In FIG. 2, finger 36 of support 34, as well as the aperture within arm 32, are all oriented in accordance with the direction taken by the trajectory of bar 18. It will be appreciated that for any intermediate direction of the trajectory of bar 18 between that illustrated in FIG. 1 and that illustrated in FIG. 2, the elements identified at 32, 34 and 36 should be oriented accordingly. It should also be understood that male element 34 may also be provided on the wall with the female element, i.e., the aperture being provided on support 34.

Figure 3:
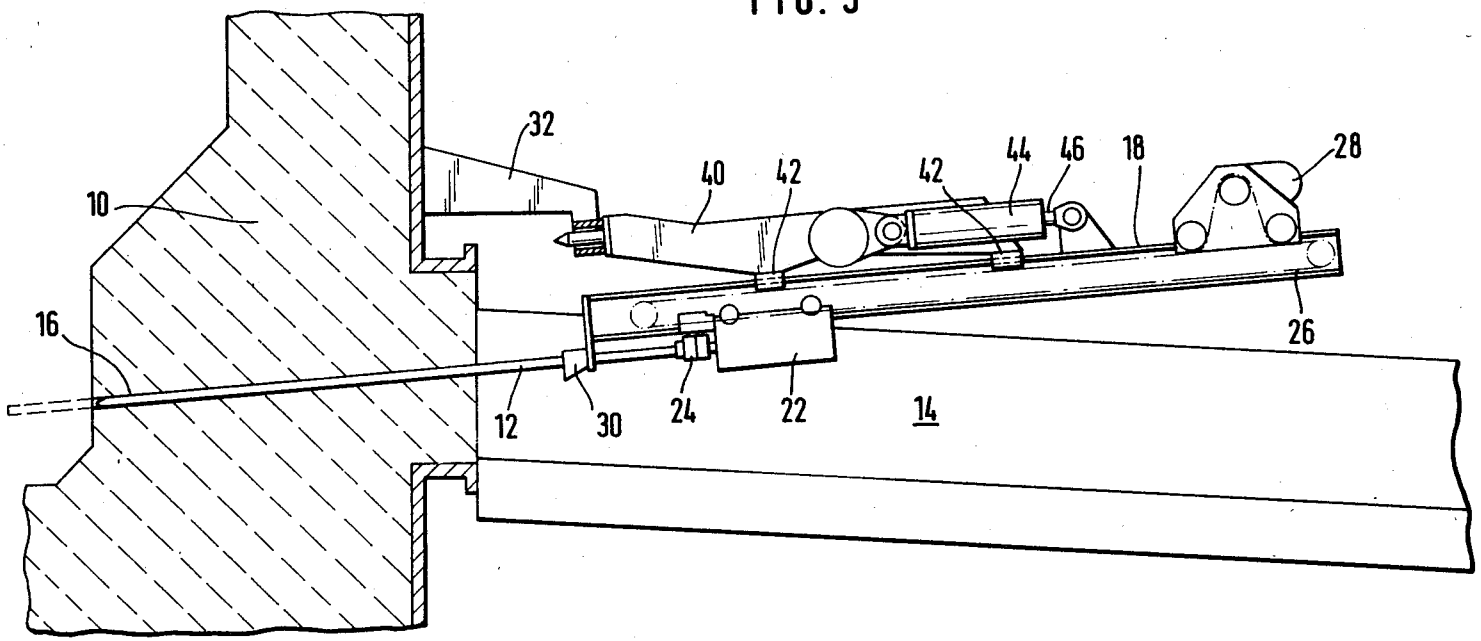
FIG. 3 is a side elevation view, partly in cross-section, of a second embodiment of a drilling device shown in an operating position in accordance with the present invention.
Figure 4:
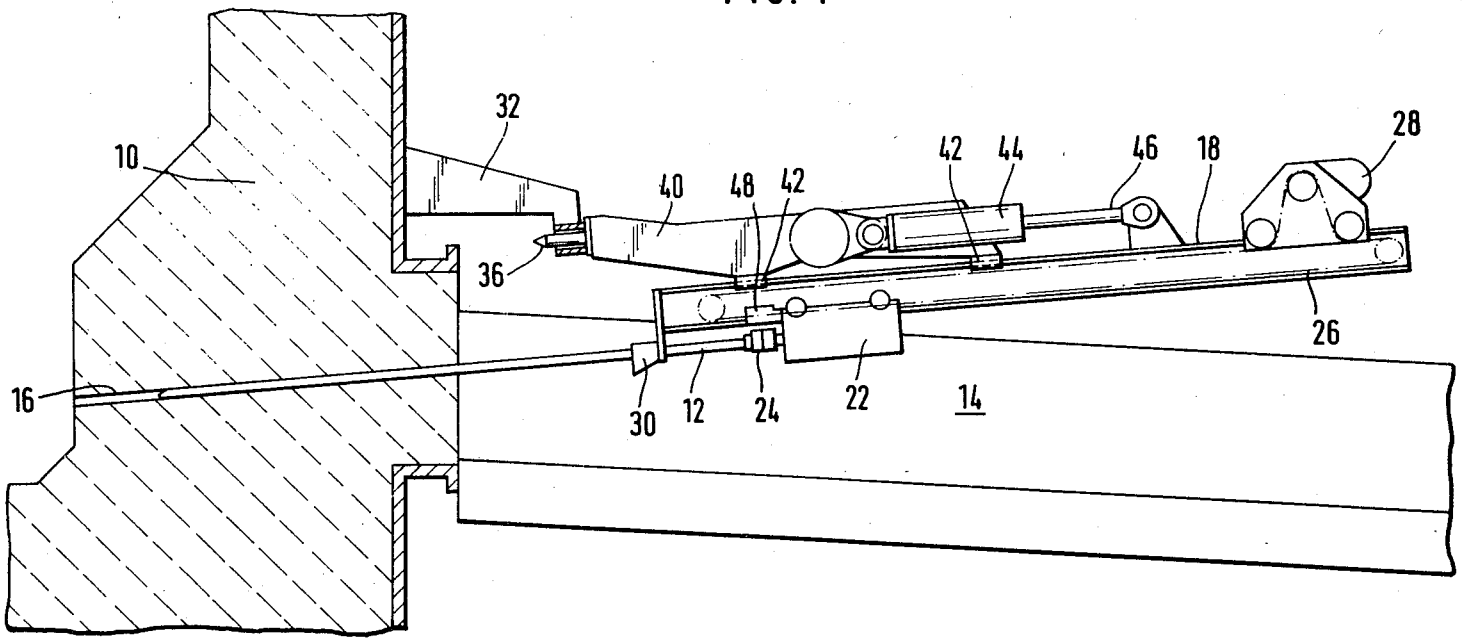
FIG. 4 is a side elevation view, partly in cross-section, of the drilling device of FIG. 3 shown during the drill rod extraction phase.
Figure 5:
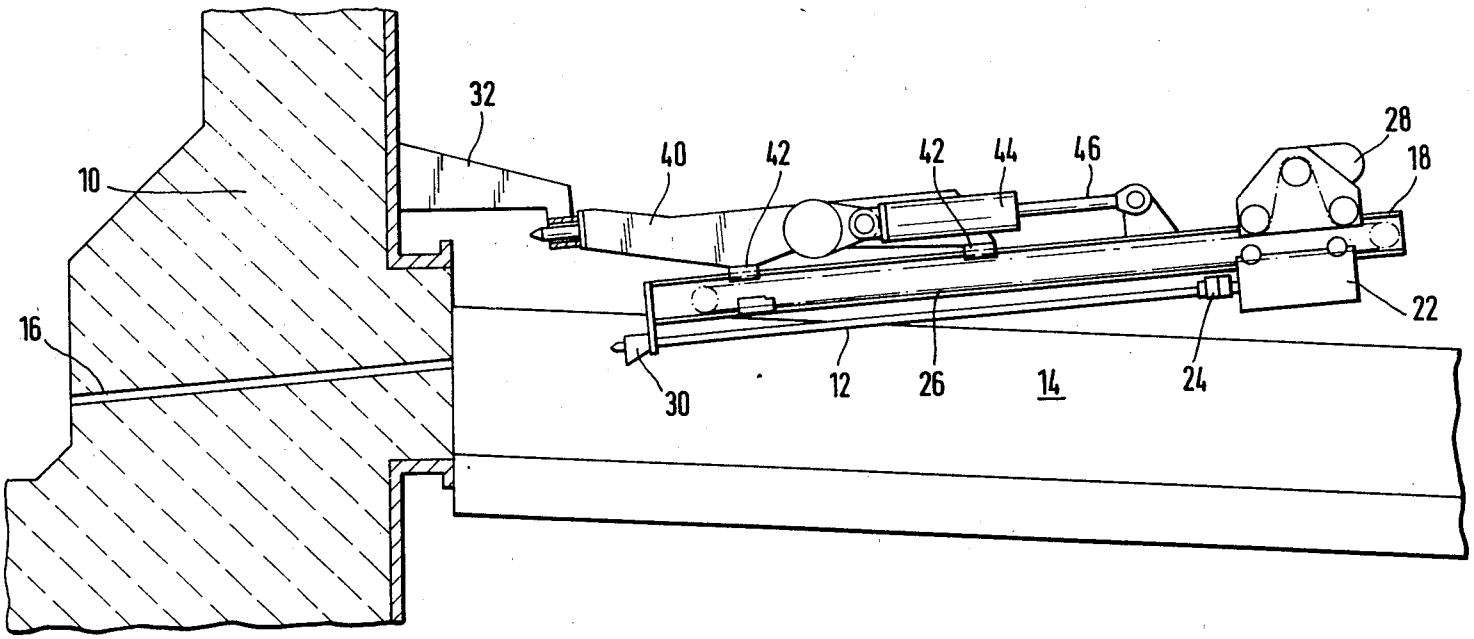
FIG. 5 is a side elevation view, partly in cross-section, of the drilling device of FIG. 3 after completion of the drill rod extraction phase.

Referring now to FIGS. 3–5, a preferred embodiment of the drilling device of the present invention is shown wherein bar 18 is not attached to the carrier arm (not shown) but instead, is slidably suspended on a support 40 which, in turn, is mounted on the end of the carrier arm and which is designed to rest against arm 32. Bar 18 may be supported on the lower portion of support 40 by any suitable means such as the two slide bars 42. Thus, bar 18 is able to perform a translatory movement with respect to support 40. The translatory movement of bar 18 with respect to support 40 is provided by a hydraulic jack 44 which is mounted on support 40. A stem or piston rod 46 of jack 44 is connected to bar 18.

The operation of the preferred embodiment of the present invention and the features and advantages thereof are evident from a description of FIGS. 3–5. Referring first to FIG. 3, drill rod 12 is extracted from furnace wall 10 by moving bar 18 into the position shown. Thus, bar 18 is moved until the support 40 rests against arm 32, stem 46 of jack 44 being retracted at this point. Jack 44 is then actuated so as to move bar 18 rearwardly, the reaction of this thrust of jack 44 being transmitted to arm 32 via support 40. The movement of jack 44 permits rod 12 (located within taphole 16) to be released as shown in FIG. 4. Drill rod 12, having been released, can now be extracted without great difficultly by urging working tool 22 to move back along bar 18 under the action of motor 28 until it reaches the position shown in FIG. 5.

In view of the above discussion, it is apparent that the relatively large forces required to release rod 12 from the position shown in FIG. 3 are derived from hydraulic jack 44 and then directly transmitted to bar 18. It is also apparent that a far more moderate force is required for the extraction of bar 12 from the position shown in FIG. 4, this more moderate force being derived from motor 28. Accordingly, the embodiment of FIGS. 3–5 offers, among other features, the advantage that chain 26 must no longer be strong enough to withstand the considerable tractive forces exerted during release of rod 12 and that motor 28, if necessary, may be of the pneumatic type.

The embodiment shown in FIGS. 3–5 offers yet a further extremely important advantage over the embodiment of FIGS. 1–2. As has already been stated, the lower end of drill rod 12 is consumed in the molten metal as shown by the dotted lines in FIGS. 1 and 3. Accordingly, drill rod 12 is relatively shorter when it is extracted from the taphole as compared to when it is originally deposited therein. Consequently, as the end of the extraction phase is approached, tool 22 reaches the rear end of bar 18 and the front portion of drill rod 12 will no longer be supported by support head 30. As a result, rod 12 will tilt into tap channel 14 thereby risking damage, particularly to coupling device 24. One way of remedying this problem is by the use of displaceable and/or pivotable auxiliary hooks such as those described in patent application No. DE-A-3111260, all the contents of which are incorporated herein by reference. This above-described problem has already been eliminated in the embodiment shown in FIGS. 3–5 as bar 18, and particularly the length of travel of tool 22, can be shortened by a distance corresponding to the travel of rod 46. Thus, if the trajectory of bar 18 is made substantially equal to the length of that portion of rod 12 which is likely to be consumed inside the furnace or to be broken during the release of rod 12, it will nevertheless continue to be supported by support head 30, even when working tool 22 is completely retracted as shown in FIG. 5.

It will be appreciated that in order to prevent the thrust of hydraulic jack 44 from being transmitted to chain 26 between the position of the present invention shown in FIG. 3 and the position shown in FIG. 4, bar 18 is provided with a stop 48 which serves as a support for tool 22.

Referring now to FIG. 6, in order to also protect coupling device 24 from being damaged from the force or thrust of hydraulic jack 44, stop 50 is preferably provided. Stop 50, which is mounted underneath bar 18 has a cross-section such as shown in FIG. 6A. Stop 50 is preferably mounted in bar 18 so that it can be detached from and moved along the bar 18. Accordingly, the position of stop 50 can be selected in accordance with the length of the taphole whereby stop 50 can be utilized as a locating device upon insertion of rod 12. It will be appreciated that stop 50 acts as a locating device by feeding the coupling device forward until it comes to rest against the stop.

FIGS. 7 and 7A shown a preferred alternative embodiment of the stop 50 of FIGS. 6 and 6A wherein the supporting and guiding head 30 shown in FIGS. 1–5 can be eliminated. The elimination of support 30 is realized because alternative stop 52 serves a dual purpose. Thus, stop 52 acts both as a guiding and supporting device for drill rod 12 as well as a coupling device. Stop 52 is preferrably constructed in a funnel shape as shown in FIGS. 7 and 7A. The advantages discussed above with regard to stop 50 in connection with the extraction of a partially consumed drill rod 12 are achieved to an even greater extent with use of the preferred stop 52.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Taphole opening device for a shaft furnace wherein the opening and closing of the taphole comprises the positioning and extraction of a drill rod which is left inside the taphole between successive tappings comprising:

an elongated bar;

uni-directional percussion means, said percussion means being slidably mounted on said bar;

driving means being associated with said elongated bar;

motor means, said motor means actuating said driving means to slide said percussion means along said bar;

coupling means communicating with said percussion means for coupling said drill rod to said percussion means;

drill rod guiding and supporting means communicating with said bar;

means for supporting said bar against said furnace during the extraction of said drill rod;

support means, said bar being slidably suspended on said support means, said support means being connected to said bar supporting means; and hydraulic jack means mounted on said support means, said jack means including a piston rod being connected to said bar, said hydraulic jack means urging said bar to perform a translatory movement in relation to said support means.

2. The device of claim 1 wherein:

said motor means is a pneumatic motor.

3. The device of claim 1 wherein:

said motor means is a hydraulic fluid motor means.

4. The device of claim 1 wherein:

said elongated bar is slidably suspended on said support means via slide bar means.

5. The device of claim 1 wherein said bar supporting means includes:

a male and female supporting element, one of said elements being respectively attached to said furnace and to said support means, said male and female supporting elements being capable of removable mating.

6. The device of claim 5 wherein:

said supporting element attached to said supporting means is integrally attached thereto.

7. The device of claim 1 further including:

stop means associated with said bar wherein said percussion means is selectively prevented from sliding along said bar.

8. The device of claim 7 wherein:

said stop means is adjustably positioned on said bar.

9. The device of claim 8 wherein:

said stop means provides guidance and support for said drill rod.

10. The device of claim 9 wherein:

at least a portion of said stop has a funnel shape.

11. The device of claim 1 wherein:

said driving means comprises an endless chain.

12. The device of claim 1 wherein:

said support means is pivotably mounted on a carrier arm.

* * * * *